US009089891B2

(12) United States Patent
Boguslawskij

(10) Patent No.: US 9,089,891 B2
(45) Date of Patent: Jul. 28, 2015

(54) METHOD OF MAKING CUTTING TOOL EDGES, A DEVICE FOR REALIZING SAME, AND A STRIKER USED IN THE SAID DEVICE

(75) Inventor: Boris Boguslawskij, Berlin (DE)

(73) Assignee: KAN-TECH GMBH (DE)

( * ) Notice: Subject to any disclaimer, the term of this patent is extended or adjusted under 35 U.S.C. 154(b) by 2323 days.

(21) Appl. No.: 11/795,393

(22) PCT Filed: Jan. 13, 2006

(86) PCT No.: PCT/EP2006/000359

§ 371 (c)(1),
(2), (4) Date: Mar. 21, 2011

(87) PCT Pub. No.: WO2006/077072

PCT Pub. Date: Jul. 27, 2006

(65) Prior Publication Data

US 2011/0226029 A1 Sep. 22, 2011

(30) Foreign Application Priority Data

Jan. 18, 2005 (RU) ..... 2005100982

(51) Int. Cl.
*B21J 5/00* (2006.01)
*B21J 13/02* (2006.01)
*B21K 11/00* (2006.01)

(52) U.S. Cl.
CPC .. *B21J 5/00* (2013.01); *B21J 5/006* (2013.01); *B21J 13/02* (2013.01); *B21K 11/00* (2013.01)

(58) Field of Classification Search
CPC ..... B21J 5/00; B21J 5/006; B21J 13/02
USPC ..... 72/67, 75, 76, 112, 214, 379.2, 406, 72/710; 76/58, 89.2, 101.1, 116; 30/49, 30/346.55; 156/580.1, 580.2; 228/1.1
See application file for complete search history.

(56) References Cited

U.S. PATENT DOCUMENTS

| | | | | | |
|---|---|---|---|---|---|
| 1,739,738 | A | * | 12/1929 | Schumacher | 451/331 |
| 1,877,758 | A | * | 9/1932 | Kylberg | 72/333 |
| 2,939,252 | A | * | 6/1960 | Cooke | 451/165 |
| 3,055,241 | A | * | 9/1962 | Hedgecock et al. | 72/205 |

(Continued)

FOREIGN PATENT DOCUMENTS

| | | |
|---|---|---|
| EP | 1 382 414 | 1/2004 |
| GB | 14 539 857 | 2/1979 |

(Continued)

OTHER PUBLICATIONS

International Search Report dated Apr. 5, 2006 in corresponding application PCT/EP2006/000359, 3 pages.

*Primary Examiner* — Edward Tolan
(74) *Attorney, Agent, or Firm* — Karin L. Williams; Mayer & Williams PC

(57) ABSTRACT

The method of the invention includes forming a plate and deforming, by ultrasonic forging, a plate side located between the conical surfaces (34, 35) of strikers (2, 3) for the purpose of forming a wedge-shaped edge on the plate (1). The strikers are rotated around their longitudinal axes (L1, L2). The device of the invention is provided with a drive for rotating the strikers (2, 3). On the working surface of the striker (2, 3) a recess is made, the generatrix of which corresponds to the form of the wedge-shaped edge surface. The invention enables to shorten the time of treatment and improve the quality of the cutting edge surface.

30 Claims, 7 Drawing Sheets

(56) References Cited

U.S. PATENT DOCUMENTS

| | | | | | |
|---|---|---|---|---|---|
| 3,318,129 | A | * | 5/1967 | Gross | 72/199 |
| 3,341,935 | A | * | 9/1967 | Balamuth | 425/78 |
| 3,495,427 | A | * | 2/1970 | Balamuth | 72/56 |
| 3,866,452 | A | * | 2/1975 | Neilsen | 72/211 |
| 4,129,027 | A | * | 12/1978 | Ignashev et al. | 72/429 |
| 4,152,914 | A | * | 5/1979 | Tyavlovsky et al. | 72/38 |
| 4,470,281 | A | * | 9/1984 | Kaporovich et al. | 72/68 |
| 5,110,403 | A | * | 5/1992 | Ehlert | 156/580.1 |
| 5,454,248 | A | * | 10/1995 | Inatani | 72/84 |
| 5,645,470 | A | * | 7/1997 | Ludwig | 451/45 |
| 6,089,065 | A | * | 7/2000 | Deriaz | 72/96 |
| 7,059,163 | B2 | * | 6/2006 | Hartung et al. | 72/252.5 |

FOREIGN PATENT DOCUMENTS

| | | | | | |
|---|---|---|---|---|---|
| JP | 55-22411 | A | * | 2/1980 | B21B 27/02 |
| JP | 62-21439 | A | * | 1/1987 | B21J 9/02 |
| JP | 04-084695 | | | 3/1992 | |
| JP | 2000-326016 | | | 11/2000 | |
| WO | 02/087818 | A2 | * | 11/2002 | B23P 15/28 |

* cited by examiner

METHOD OF MAKING CUTTING TOOL EDGES, A DEVICE FOR REALIZING SAME, AND A STRIKER USED IN THE SAID DEVICE

The invention relates to machine-building, in particular to metal-working by ultrasonic forging, and may be used for making edges with improved performance and for forming cutting edges of small thickness.

A method of grounding (USSR Patent No. 318205, B 24 B 3/48, publ. in 1971) is commonly used for making cutting edges of small thickness, e.g., in razor blades. Shortcomings of a grounding method are: insufficient quality of the edge surface due to the presence of large metal grains in the cutting edge area; complex and labor-consuming procedure of many consecutive grounding operations due to the necessity of using high-precision process equipment and special tooling; carrying out hardening before forming blade cutting edge, which makes working more difficult; moreover, a blade made by grounding is subject to corrosion in storage, which is conditioned by the fact that in the process of making shape of a cutting edge by grounding very high local temperatures are developed, which influence metal after hardening as its tempering, after which its corrosion resistance and wear resistance are reduced.

Known in the art are methods of rolling using longitudinal ultrasonic vibrations, which consist in that during commonly used rolling ultrasonic vibrations are excited in rolls with the use of magnetostrictors attached to the roll ends (see: V. P. Severenko, V. V. Klubovich, A. V. Stepanenko "Rolling and drawing with ultra sound", Nauka I Technika Publ. House, Minsk, 1970, p. 136-181). When rolling with the use of ultra sound vibrations having different amplitudes are applied to a worked material, which is connected to the parallel arrangement of rolls relative to a plate, as well as to a significant length of the deformation area. Furthermore, ultrasonic vibrations in rolling are only a supplementary means for reducing frictional forces and increasing, to some extent, plasticity of a material being worked. In a forging process with the use of ultrasound vibrations are oriented along the longitudinal axis of strikers, i.e. in the direction orthogonal to the plate. The plate edges are deformed by ultrasonic forging mainly due to acoustic energy itself. Thus, the processes going on when a worked material is deformed by forging with the use of ultrasound and by rolling with the use of ultrasound are completely different, where, the frictional forces appearing in the process of rolling with the use of ultrasound, unlike those appearing in the process of forging, are directed strictly along the longitudinal axis of the plate.

Methods using ultrasonic forging for forming a blade cutting edge enable to obtain higher quality cutting edges due to breaking metal grains directly in the cutting edge area. However, in most cases, in order to for a high-quality blade cutting edge, the known methods require multiple passes of a plate between strikers of an ultrasonic device, usually from three to ten passes, and, in order to obtain a high-quality surface, such methods usually require that additional finishing operations should be carried out, e.g., electro-chemical sharpening in an electrolytic solution (RF Patent No. 2025189, B 21 K 11/00; publ. in 1994).

The necessity of carrying out finishing operations for the purpose of obtaining very high-quality blades after ultrasonic treatment of the plate end is conditioned by the fact that metal in the front part of a cutting edge, when being influenced by ultrasound, flows into various directions, which results in formation of a burr in the front part of the cutting edge, rather than by metal tempering processes developed when grounding it.

For removing surface layers of metal additional improvements should be used, e.g., the striker axes are to be inclined to each other in order to form a slot enabling the surface layers of metal to outflow (USSR Inventor's Certificate No. 1827904, B 21 J 5/00; publ. in 1991).

Known in the art is a method of making a cutting tool edge, comprising forming a plate, deforming the plate end located between the conical surfaces of strikers by ultrasonic forging, with simultaneously moving the plate relative to the striker axes in the transverse direction for the purpose of forming a wedge-shaped edge on the plate (USSR Inventor's Certificate No. 1720779, B 21 K 11/00, B 21 J 5/00; publ. in 1991). According to the said method, a blank, when being deformed, is moved in the direction transversal to the applied static dragging power, and a size of the clearance between the strikers is maintained during the whole deformation cycle at the level of the double amplitude of ultrasonic vibrations. An advantage of the said method consists in the possibility of obtaining a finished product with the cutting edge thickness of 1-3 microns, without a burr or with a minimum burr.

The shortcomings of the said method are: the complex method of ultrasonic forging due to the necessity of selecting a value of the static end force at given variations in the plate dimensions and deviations of the true trajectory of the plate movement from the value set in the blank movement mechanism; difficulty of maintaining the set value of clearance between the strikers during the whole deformation cycle; the necessity of several traverse passes of the plate between the strikers for the purpose of obtaining a cutting edge of minimum thickness. The main constraint of the said method, which seemingly enables high-quality cutting edges having small metal grains and minimum thicknesses, as studies have shown, is the presence of a hidden defect in the form of a narrow slot-like microscopic void located in the plane of symmetry of the cutting edge.

In order to remove this defect, in the known technical solution the plate edge is rounded (RF Patent No. 2211742, B 21 K 11/00; publ. in 2003). The restraint of the said method is the necessity of carrying out additional operations for the purpose of making a blank itself, which is preliminarily beveled by rolling, grounding, pressing in a die or preliminary ultrasonic forging of a plate end. The main shortcoming of this process, which is also typical for the said known methods of ultrasonic forging, is an small area of the working surface of the strikes used for deformation, which results in quick wear of the striker working surfaces, shutdowns of the process, tool repairs and re-adjustment of the equipment.

Thus, the most close is the method of making a cutting tool edge, which includes deforming the plate side located between the cone-shaped surfaces of the strikers by ultrasonic forging, while simultaneously moving the plate relative to the striker longitudinal axes crosswise for forming a wedge-shaped edge on the plate (RF Patent No. 2211742, B 21 K 11/00; publ. in 2003).

Known in the art is a device for making a cutting tool edge, which comprises: strikers connected to a source of ultrasonic vibrations, arranged one opposite the other, and having working surfaces made cone-shaped, and a mechanism made so as to ensure the plate movement between the striker working surfaces transversely relative to their longitudinal axes and installed with the possibility of deforming a plate side (RF Patent No. 2211742, B 21 K 11/00; publ. in 2003). Also known is a striker for ultrasonic making of a cutting tool edge, which has the working surface made cone-shaped and intended for deforming a plate side by ultrasonic forging for the purpose of producing a wedge-shaped blade (RF Patent No. 2211742, B 21 K 11/00; publ. in 2003).

The task, as solved by this invention, is to improve the quality of the finished product and the technological operations carried out to make it, reduce laboriousness, increase the operation period for the equipment without its re-adjustment, as well as to improve the conditions for automation of the method by reducing the number of passes necessary for forming the cutting edge.

The technical result, which may be achieved when practicing the claimed method, relates to an improvement in the cutting edge quality while maintaining its set thickness, reduction of the time required for working metal, improvement of the cutting edge surface roughness, a reduction in the number of operations required to work a blank in the process of ultrasonic forging, an increase of the wear-out period of the tools, an improvement of the process controllability and automation. The technical result, which may be achieved while making the claimed device, relates to an increase of the wear-out period of the striker working surfaces, an improvement of the cutting edge quality with the simultaneous reduction in the number of passes required for making the product, an improvement of the process controllability and automation. The technical result, which may be achieved when making the claimed striker, relates to reduction of its working surface wear, an improvement of the cutting edge quality of the finished product, an increase in the period of the striker working capacity, as well as a reduction in the deformation force necessary for producing a wedge-shaped blade.

In order to solve the set task and achieve the stated technical result, the known method of making cutting tool edges, which comprises deforming a plate side located between the cone-shaped surfaces of the strikers by ultrasonic forging with simultaneously moving the plate transversely relative to the longitudinal axes of the strikers for the purpose of forming a wedge-shaped blade on the plate, is supplemented, according to the invention, with the operation of rotating the strikers around their longitudinal axes when a plate side is deformed by ultrasonic forging.

Additional variants of carrying out the claimed method are possible, wherein it is advisable that: the strikers are rotated in the direction of the plate movement; the strikers are rotated in the direction opposite to the direction of the plate movement; one striker is rotated in the direction of the plate movement, while the other is rotated in the direction opposite to the direction of the plate movement; a circumferential rotational velocity of the strikers is selected in the interval $V_{rot}=\pm\chi V_n$, where $V_n$ is the speed of the plate movement, and $\chi$ is a value in the range from 0.1 to 1.5; when deforming a plate side by ultrasonic forging the plate end should be deepened toward the striker working surfaces to a distance l, which is selected in the interval $1.1t/(4\text{tg}\ \alpha)>l\geq t/(4\text{tg}\ \alpha)$, where t is the plate thickness, and $\alpha$ is an angle between the generatrix of the striker cone-shaped surface the transverse axis of the plate, tg is the trigonometric function "tangent"; on each striker a recess with the curvilinear generatrix on its cone-shaped surface should be made, the said curvilinear generatrix should correspond to the form of a wedge-shaped blade surface produced; after deformation the plate should be thermally treated, and afterwards the edge of the wedge-shaped blade should be finished to a depth of 0.01-0.05 mm.

In order to solve the set task and achieve the stated technical result the known device for making cutting tool edge, which comprises strikers connected to sources of ultrasonic vibrations, arranged one opposite the other and having working surfaces made cone-shaped, and a mechanism made so as to ensure the plate movement between the striker working surfaces transversely relative to their longitudinal axes and installed with the possibility of deforming a plate side, is supplemented, according to the invention with a drive made with the possibility of rotating strikers around their longitudinal axes.

Additional variants of making the claimed device are possible, wherein it is advisable that: the drive should be made with the possibility of rotating the strikers in the direction of the plate movement; the drive should be made with the possibility of rotating the strikers in the direction opposite to the direction of the plate movement; the drive should be made with the possibility of rotating one striker in the direction of the plate movement and the other striker in the direction opposite to the direction of the plate movement; the working surfaces of the strikers should be made with a recess having a curvilinear generatrix; the curvilinear generatrix of the recess should be described by the quadratic polynomial $Y=\pm AX_2\pm BX\pm C$, where Y is the direction along the transverse axis of the striker, and X is the direction along the longitudinal axis of the striker; the curvilinear generatrix should be described by the quadratic polynomial $Y=-0.135X^2-0.0646X+0.05$; a distance l of deepening the plate end toward the striker working surfaces should be selected in the interval $1.1t/(4\text{tg}\ \alpha)>l\geq t/(4\text{tg}\ \alpha)$, where t is the plate thickness, and $\alpha$ is an angle between the generatrix of the striker cone-shaped surface and the transverse axis of the plate.

In order to solve the set task in a known striker for ultrasonic making cutting tool edges, which comprises the working surface made cone-shaped and intended for deforming a plate end by ultrasonic forging for the purpose of producing a wedge-shaped edge, according to the invention a recess is made on the cone-shaped working surface, the generatrix of which is made corresponding to the form of a wedge-shaped edge surface.

Additional variants of making the claimed striker are possible, wherein it is advisable that: the recess should be made with a curvilinear generatrix described by the quadratic polynomial $Y=\pm AX^2\pm BX\pm C$, where Y is the direction along the transverse axis of the striker, and X is the direction along the longitudinal axis of the striker; the curvilinear generatrix should be described by the quadratic polynomial $Y=-0.135X^2-0.0646X+0.05$.

The above-mentioned advantages as well as the specific features of this invention will be explained by describing its preferred embodiments with references to the appended drawings.

Figure 2:
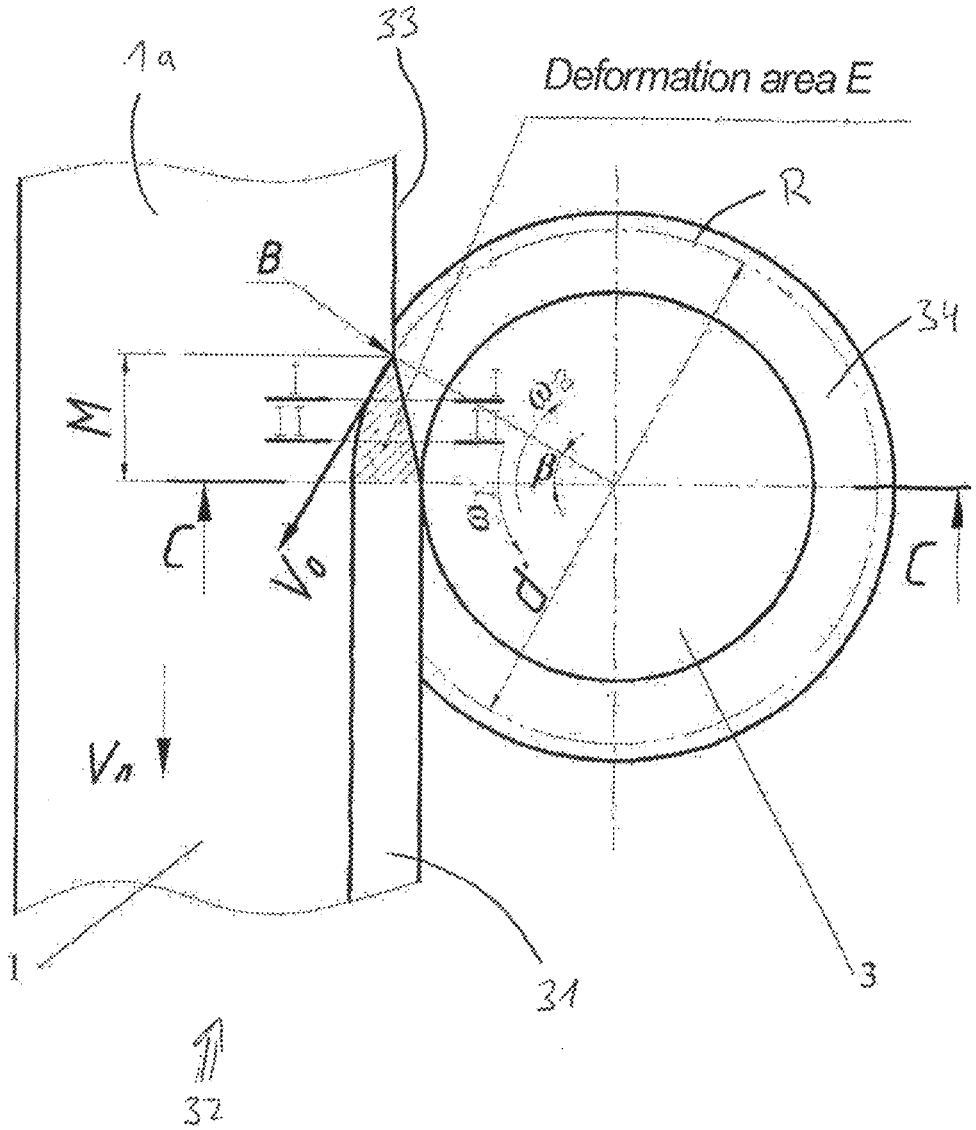
FIG. 2 is the A-A section shown in FIG. 1, where the arrows show the direction of plate movement, the direction of striker rotation, as well as the deformation area of the E plate.
Figure 3:
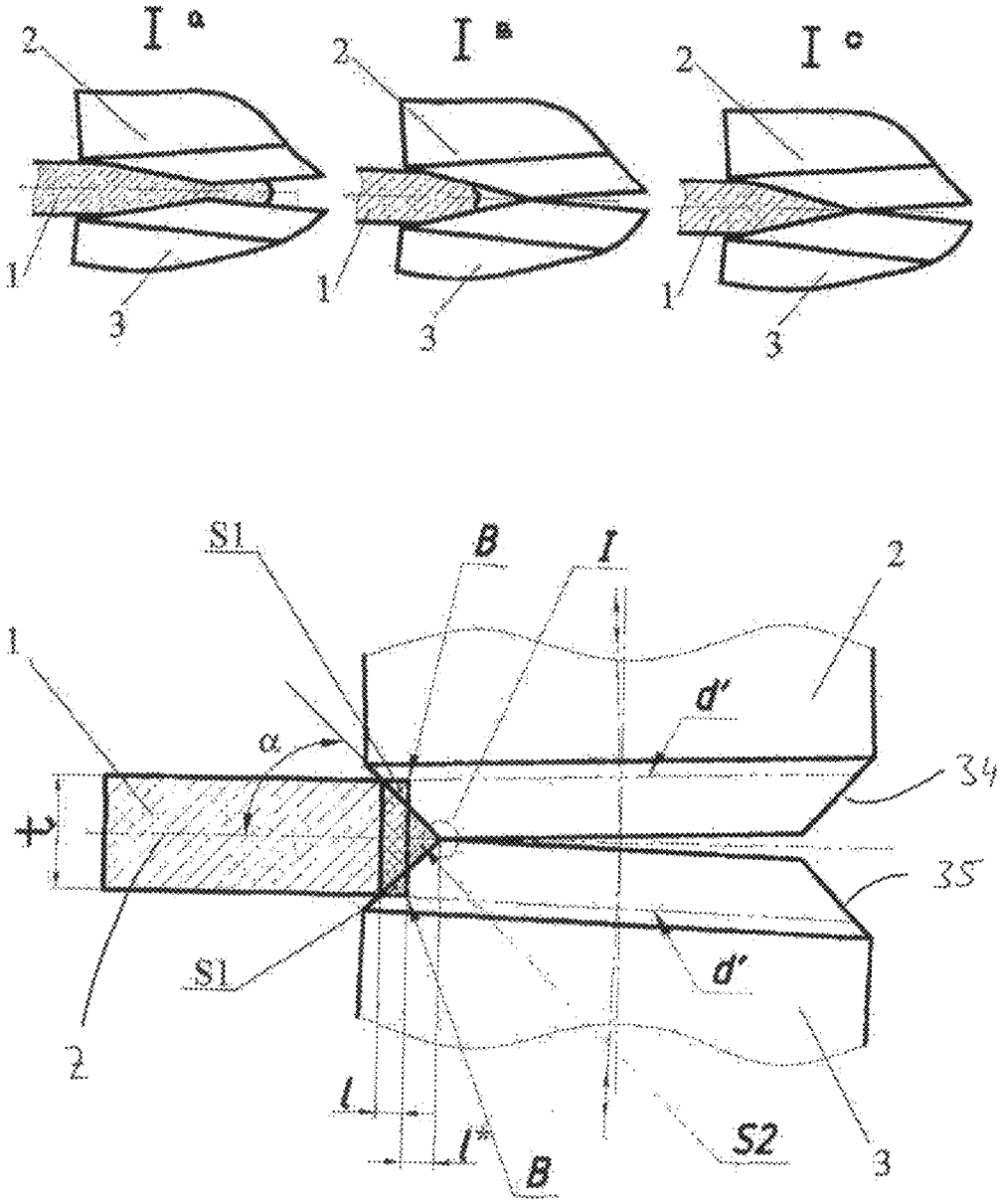
Figure 4:
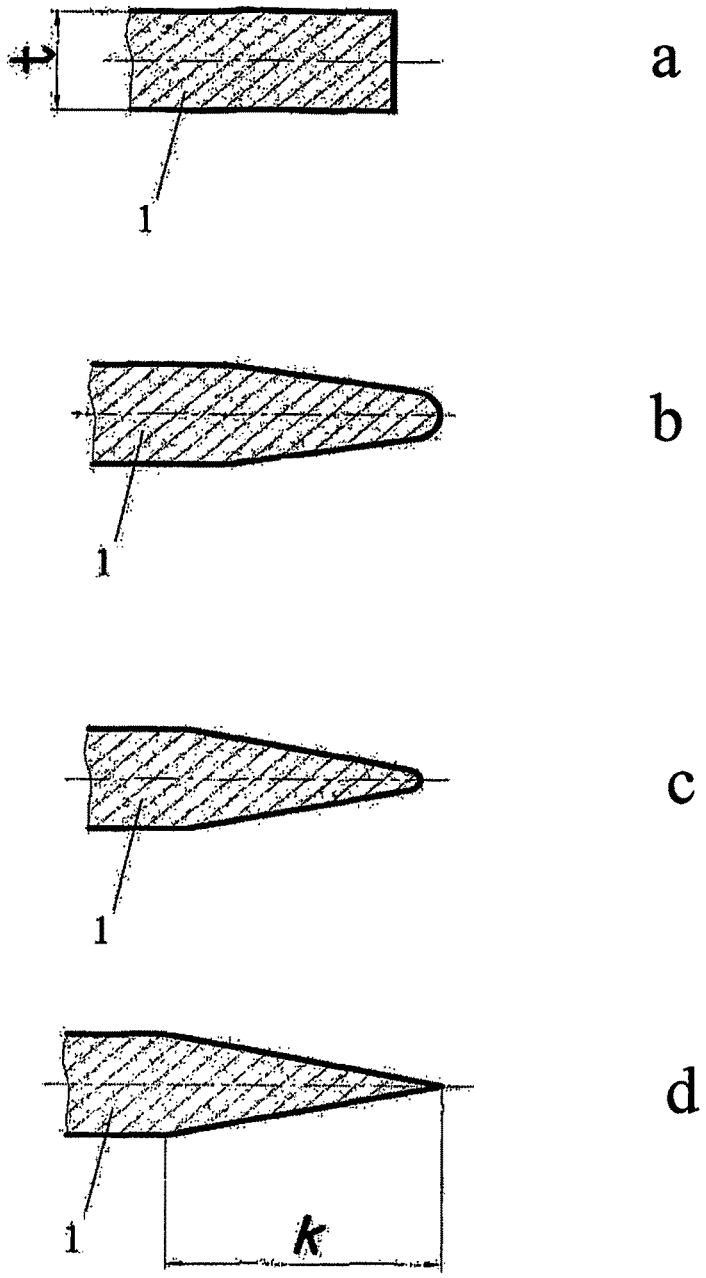
Figure 5:
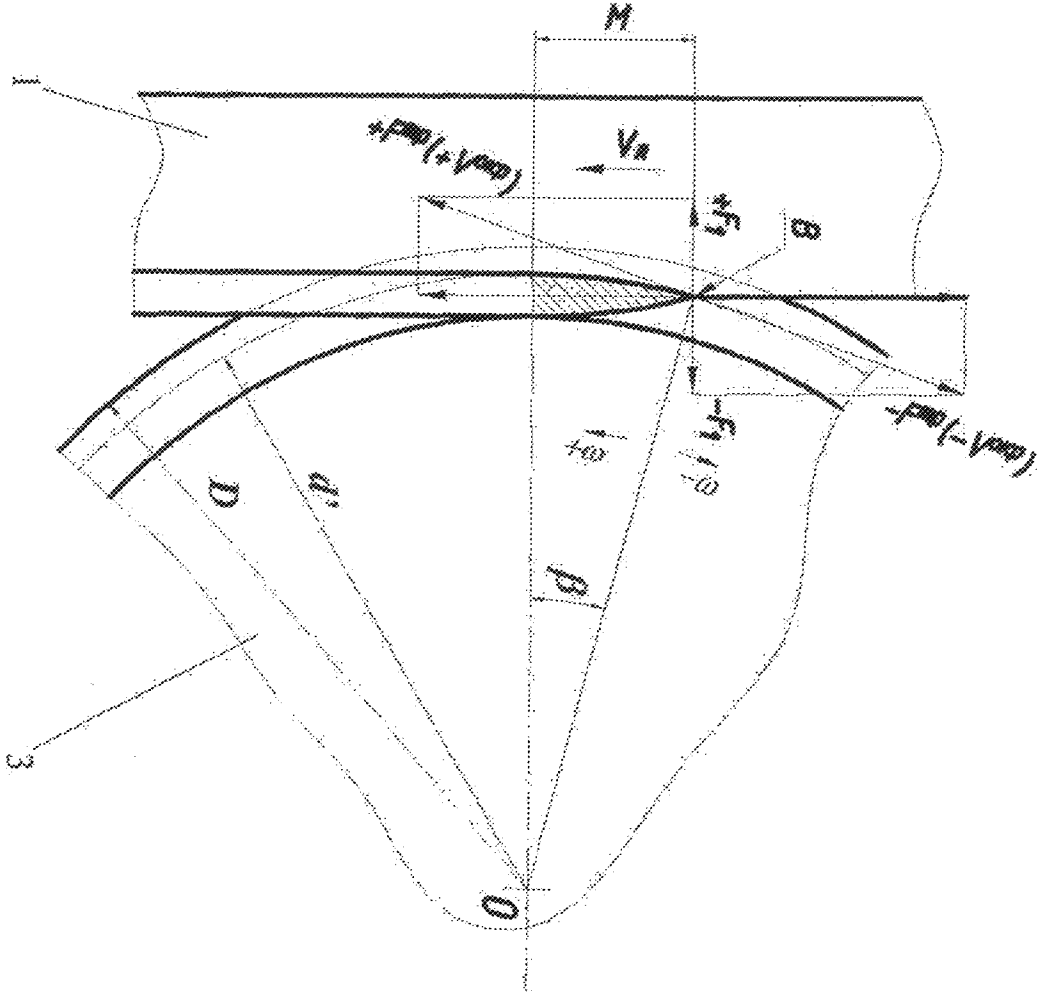
Figure 6:
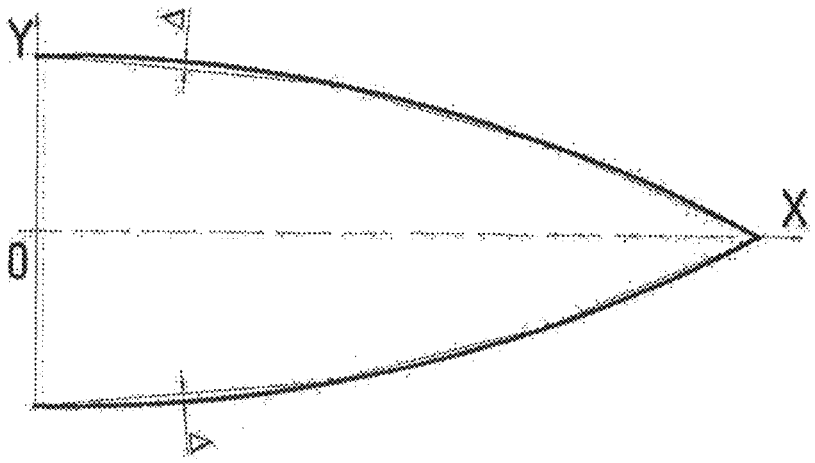

FIG. 3 is the C-C section shown in FIG. 2, where the position of a plate relative to the strikers is shown, and in the upper part of the sheet, on leaders, the position of the plate is shown, when it leaves the deformation area: $l^a$—at an excessively shifted volume of the plate, i.e., its end to a distance $l>l^*$ toward the striker working surfaces, $l^b$—at an insufficiently shifted volume $l<l^*$, and $l^c$—an ideal case where $l=l^*$;

FIG. 4 shows a scheme of changing a cross-section of a rectangular plate in the deformation area E in subfigures: a—before deformation (a cross-section through points. B in FIG. 2); b—during subsequent deformation (cross-section I-I, FIG. 2); c—in the middle of deformation (cross-section II-II, FIG. 2); d—when leaving the deformation area E (cross-section C-C, FIG. 2);

FIG. 5 is a schematic diagram of changing the frictional force components between the deformed plate and the rotating strikers;

FIG. 6 shows two curve lines corresponding the curvilinear generatrices of the recess on the working cone-shaped surfaces of the strikers.

Figure 7:
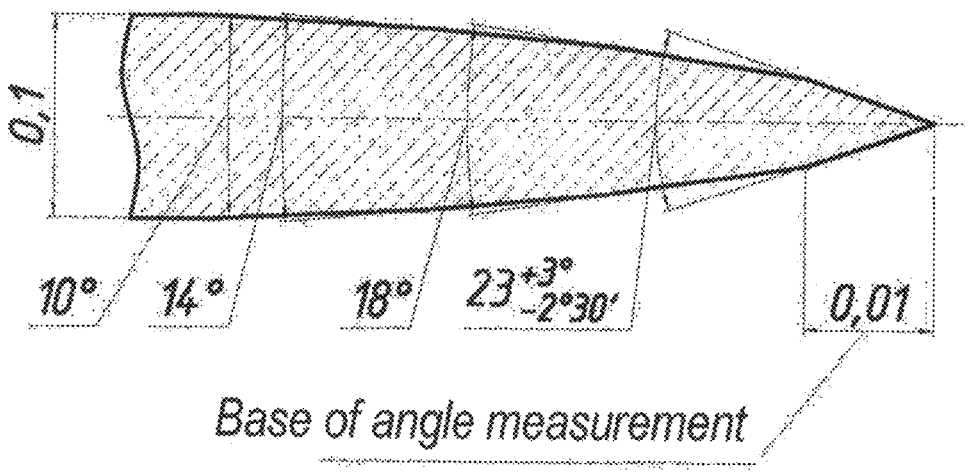
Figure 8:
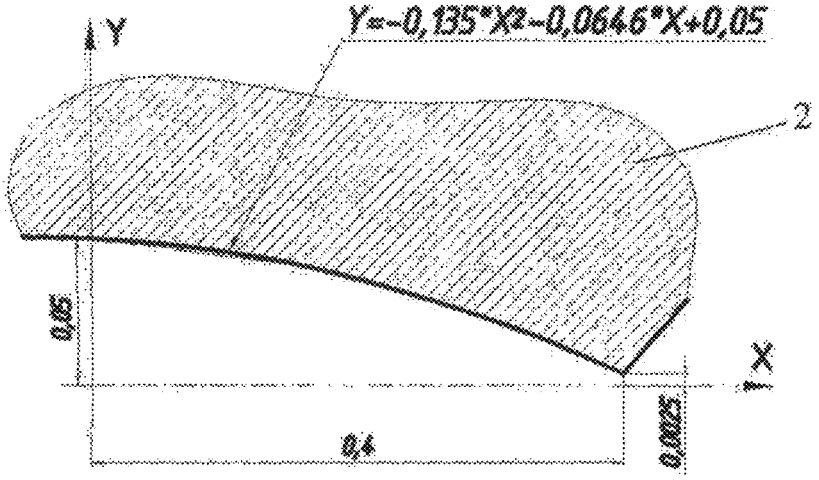
Figure 9:
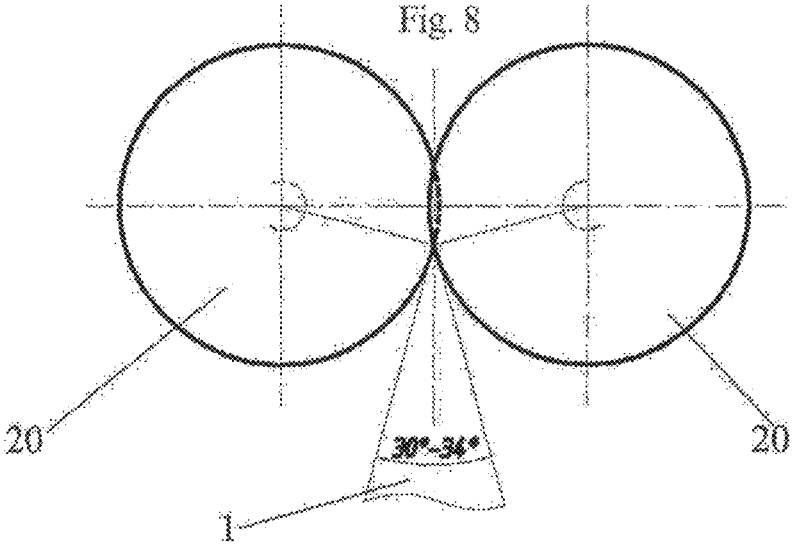

FIG. 7 shows a cross-section of a wedge-shaped razor blade produced according to a commonly known technology by several grounding passes with the formation of planes conjugated therebetween at angles, which value is gradually reduced in the direction from the edge of the blade;

FIG. 8 shows the working surface of a striker with a curvilinear generatrix approximating the broken line shown in FIG. 7;

FIG. 9 schematically shows the finishing of the tip of a cutting tool edge after a thermal treatment.

The method of making a cutting tool edge (FIG. 1, 2) includes deforming, by ultrasonic forging, a side of the plate 1, when the said side is located between the cone-shaped surfaces of the strikers 2 and 3, with the simultaneous movement of the plate 1 relative to the longitudinal axes of the strikers 2 and 3 transversely for the purpose of forming a wedge-shaped edge on the plate 1. When a side of a plate is deformed by ultrasonic forging, the strikers 2 and 3 are rotated around their longitudinal axes.

It would be understood by those skilled in the art that a drive for rotating the strikers 2 and 3 may be made completely different. In order to ensure the possibility of rotating the strikers 2 and 3 in the opposite directions, for example in such a way that the strikers can rotate in the direction of movement of the plate 1, or in the direction opposite to the direction of movement of the plate 1, or that the striker 2 can rotate in the direction of movement of the plate 1 and the striker 3 can rotate in the direction opposite to the direction of movement of the plate 1, an independent drive, which comprises two electric motors 4 and 5, may be used for rotating each of the strikers 2 and 3 individually. On each of the waveguides 6 and 7 for the strikers 2 and 3 the sleeves 8 and 9, respectively, are installed with gears, which are connected via a gear train with the gears installed on the shafts of the electric motors 4 and 5.

Figure 1:
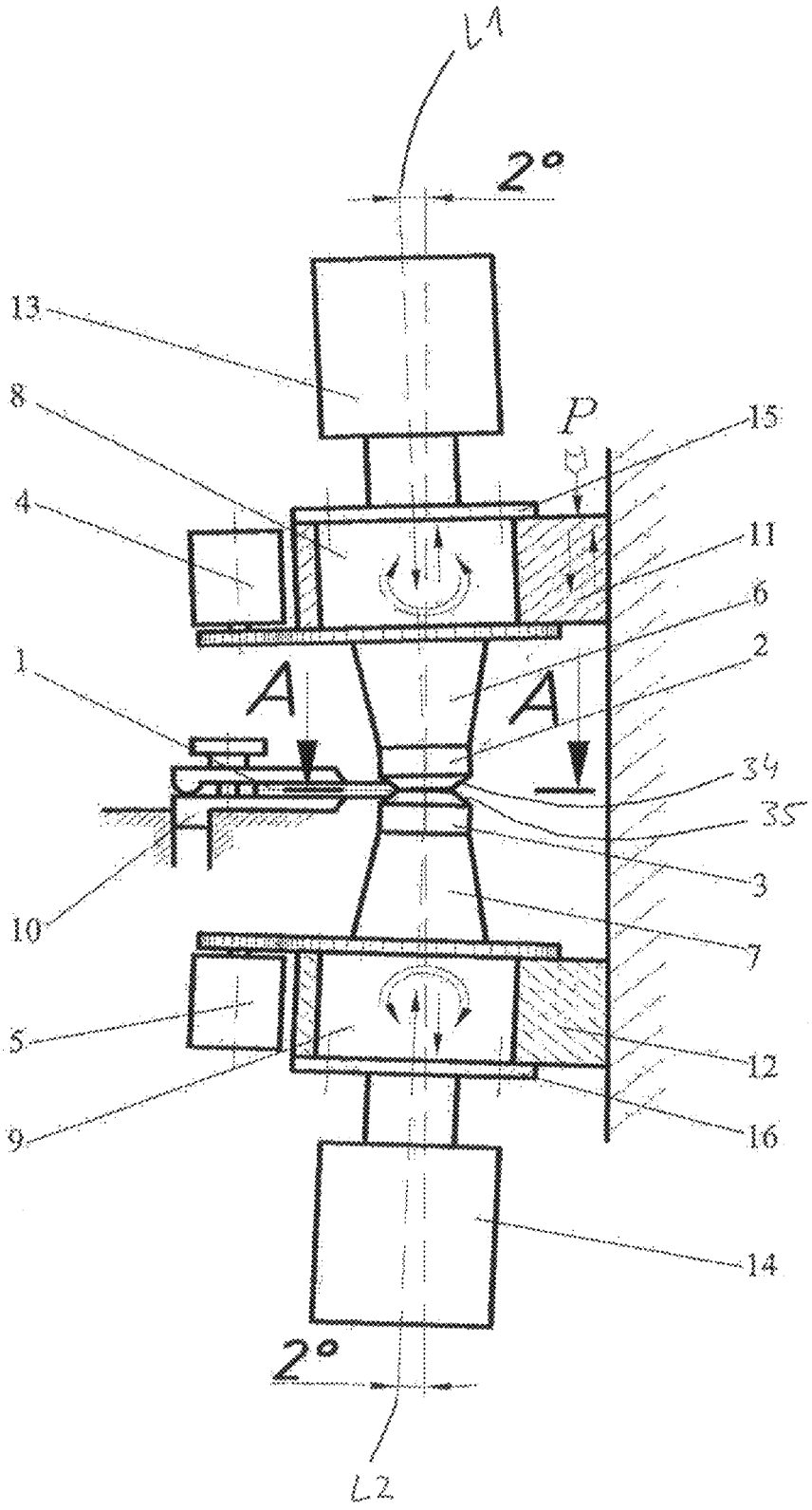
FIG. 1 shows a scheme of a device for carrying out the claimed method, where the arrows show the direction of influencing by ultrasonic vibrations, the application of a static load, and the rotation of the ultrasonic vibration converters together with the strikers attached thereto.

FIG. 1 also schematically shows: the guide 10 for moving the plate 1 transversely relative to the longitudinal axes of the strikers 2 and 3; the brackets 11 and 12 for installing the strikers 2 and 3 with the possibility of shifting their longitudinal axes by 2°; the converters 13 and 14 of electric pulses into ultrasonic vibrations, which are connected via the waveguides 6 and 7 to the strikers 2 and 3, respectively; the covers 15 and 16 installed on the sleeves 8 and 9 for fixing them and preventing them from dropping. The straight arrows in FIG. 1 along the longitudinal axes of the strikers 2 and 3 show the directions of ultrasonic vibrations; the round arrows show the possible directions of rotation of the strikers 2 and 3; and the arrow P shows the application of a static load. The bracket 12 is rigidly fixed to the vertical stand, and the bracket 11 has the possibility of moving vertically for applying the load P to the plate 1. The axes L1 and L2 of the strickers 2, 3 may be tilted against each other with a total angle between 0° and 15°, preferably between 0.5° and 6° between the axes L1 and L2.

The device works as follows (see FIG. 1). The strikers 2 and 3 are connected via the waveguides 6 and 7 to the converters 13 and 14, respectively. The waveguides 6 and 7 are rigidly fixed inside the hollow sleeves 8 and 9, which are precisely arranged in the brackets 11 and 12. The sleeves 8 and 9 with the gears are provided with the covers 15 and 16 preventing the former from dropping out, and, correspondingly, are individually rotated by the electric motors 4 and 5 with the use of the gear trains. The guide 10 with the mechanism for moving the plate 1 ensures its movement transversely relative to the longitudinal axes of the strikers 2 and 3 for the purpose of making straight cutting edges. For the purpose of making curvilinear cutting edges, e.g., for scalpels, the plate 1 is moved transversely along a set trajectory.

As studies show, the circumferential rotational velocity of the strikers 2 and 3 may be selected in a wide range, and it depends on the material of the plate 1, its hardness, the material of the strikers 2 and 3 and their hardness. For example, the higher is the circumferential rotational velocity of the strikers 2 and 3 in the direction of movement of the plate 1 (see FIG. 2), the lesser is wear of their working surfaces, but the quality of a wedge-shaped edge is somehow impaired, and the sizes of microscopic irregularities grow. The higher is the circumferential rotational velocity of the strikers 2 and 3 in the direction opposite to the direction of movement of the plate 1, the quicker is wear of their working surfaces, but in this case the quality of a wedge-shaped edge is better, and the sizes of microscopic irregularities decrease.

Microscopic irregularities in the process of ultrasonic forging by cone-shaped sides 2 and 3 appear practically always, which is connected with a frequency of ultrasonic vibrations: The higher the frequency of ultrasonic vibrations, the smaller the sizes of irregularities. Under the action of ultrasonic vibrations (see the direction of the straight arrows in FIG. 1) when deforming the plate 1 and its movement at a speed $V_n$ (FIG. 2), the cone-shaped surfaces of the strikers 2 and 3 are quasi-reorganized in the common case into the flat surface of a wedge-shaped edge. The line, along which the cone-shaped surfaces of the strikers 2 and 3 are conjugated with an end of the plate 1, makes vibrations directly related to an ultrasonic frequency. Since this line vibrates with an ultrasonic frequency, irregularities appear, which are, surely, significantly less than at usual grounding and have, in contrast to grounding, longitudinal, rather than radial, orientation.

With due regard to selected vector directions of movements of the plate 1 and the strikers 2 and 3, the circumferential rotational velocity $V_{rot}$ of the strikers 2 and 3 may be selected in the interval $\pm\chi V_n$, where $V_n$ is the movement speed of the plate 1, and $\chi$ is a value within the range from 0.1 to 1.5. Thus, for example, at $V_n$=10 m/min the circumferential rotational velocity $V_{rot}$ of the strikers 2 and 3 may be in the interval from $V_{rot}$=1 m/min to $V_{rot}$=15 m/min.

The process of deforming the plate 1 is explained with the use of FIGS. 2-5.

With reference to FIG. 2 and FIG. 3, when the plate 1 moves in the said direction at a speed $V_n$, irrespective of the rotational direction of the strikers 2 and 3, the deformation area E begins in points B located on the diameter d' and has a length M depending on the angles $\alpha$ and $\beta$.

The beginning of the plastic deformation directly depends on a thickness t of the plate 1. FIG. 3 shows a scheme of transforming the deformation area of the rectangular plate 1 into a wedge-shaped cutting edge, by which a size l of positioning the plate 1 relative to the strikers 2 and 3 may be determined. According to FIG. 3, in an ideal case the areas $S_1$ of the two triangles located on sides of the plate 1 should be completely transformed into the area $S_2$ of one triangle located in the area of the produced cutting edge (i.e., located in the vertex of conjugation of the cone-shaped surface of the strikers 2 and 3 with their flat surfaces of the least diameter). At that, the deepening l of the plate 1 into the forging area would be $l=t/(4\text{tg}\,\alpha)$, where t is the plate thickness, and $\alpha$ is an angle between the generatrix of the cone-shaped surface of the striker (2 or 3) and the transverse axis of the plate 1. As is seen on FIG. 3, the deepening to a distance l is a distance, to which the end of the plate 1 enters the forging area, transversely relative to the longitudinal axes of the strikers 2 and 3, by the cone-shaped surfaces of the strikers 2 and 3.

With reference to FIG. 3, the leaders to the area I, which is shown by a circumference, present the situation $I^a$ when the value l is made higher, $I^b$ is made lesser, $I^c$ is an ideal case. As the practice shows, the position $I^a$ is a preferable one, since the presence of a burr of 0.01-0.05 mm does not form an obstacle for finishing works, but insufficient filling of the wedge (variant $I^b$) may raise difficulties due to significant volume of metal to be removed when carrying out finishing precision grounding. The ideal case ($I^c$) is practically unattainable due to variations in the thickness t of the plate 1 and errors in other parameters determining the volume of material to be transformed. Therefore, as tests have shown, when deforming a side of the plate 1 by ultrasonic forging, its end should be deepened toward the working surfaces of the strikers 2 and 3 to a distance l, which is best selected in the interval $1.1t/(4tg\ \alpha)>1\geq t/(4tg\ \alpha)$. In this case a wedge-shaped edge may be produced for one pass of the plate 1.

In FIG. 3 an undesirable case is shown, which corresponds to the variant $I^b$ where the areas of the two triangles S1 located on the sides of the plate 1 may not be completely transformed, when the plate 1 is deformed, into the area of one triangle S2 located in the area of the edge thus produced. At an angle α, equal to 45° for the sake of explanation of the process carried out and the simplicity of understanding the drawing, though, in reality, there may not be cutting angles equal to 90° (actual cutting angles are from 10° to 30°) for the variant $I^a$ the value l (shown on the left) should be somewhat greater than the value l* (shown on the right). For the ideal variant $I^C$ the value l (shown on the left) should be equal to the value l* (shown on the right).

FIG. 4 represents a scheme of forming a wedge-shaped cutting edge on a rectangular plate 1 by ultrasonic forging according to the ideal variant $I^c$: a—before deformation (a cross-section through points B in FIG. 2); b—during subsequent deformation (cross-section I-I, FIG. 2); c—in the middle of deformation (cross-section II-II, FIG. 2); d—at the time when a finished product leaves the working surfaces of the strikers 2 and 3 (cross-section C-C, FIG. 2) and the produced cutting edge width of the wedge-shaped blade is equal to k.

With reference to FIG. 2 and FIG. 3, it can be seen on the deformation area E that metal is shifted transversely to the movement direction of the plate 1, i.e., toward the side where the edge of the wedge-shaped blade is formed, which is facilitated by the action of the strikers 2 and 3 on the worked metal in the local area, while the remaining part of the plate 1 is in the "frozen" condition.

FIG. 5 shows practically the same things as FIG. 2, but on a larger scale and with the demonstration of the frictional forces arising during the process of ultrasonic forging when the strikers 2 and 3 are rotated.

Now, variants may be considered where the strikers 2 and 3 may rotate at an angular speed +ω in the movement direction of the plate 1 and −ω in the opposite direction.

The deformation of the plate 1 begins in the point B located on the diameter d', which depends on the thickness of the plate 1 and the angle α of the cone-shaped working surface of the striker 2 or 3, and stops on the line perpendicular to the longitudinal axis of the plate 1 and going through the longitudinal axes of the strikers 2 and 3. The angle α is an angle between the generatrix of the cone-shaped surface of one of the strikers 2 or 3 and the transverse axis of the plate on the line perpendicular to the longitudinal axis of the plate 1 and going through the longitudinal axes of the strikers 2 and 3.

Let's consider the process proceeding in the point B at an angle speed +ω and $V_{rot}\geq V_n$, where $VK_{rot}$ is the circumferential rotational velocity of the strikers 2 and 3, and $V_n$ is the linear speed of movement of the plate 1. The frictional force $+F^{fr}$, and, correspondingly, the circumferential velocity $+V_{rot}$, goes via the point B at a tangent to the diameter d'. The force $+F^{fr}$ may be decomposed, according to the vector rule, into two components, one of which is directed along the movement of the plate 1, and the other component $+F_1$ is directed transversely to the longitudinal axis of the plate 1. As can be seen in FIG. 5, the frictional component $+F_1$ prevent metal from moving in the upper layers of the plate 1 toward the strikers 2 or 3.

It may be stated:

$$+F_1 = F^{fr}\cdot\sin\beta = F^{fr}\cdot\frac{2\cdot M}{d'} = F^{fr}\cdot\frac{2\cdot\sqrt{d'\cdot l - l^2}}{d'};\ \text{where}$$

$$l = \frac{t}{4\cdot tg\alpha}.$$

The above mathematical expression shows that the force $+F_1$ decreases with an increase in the diameter d', the angle of the cone a of the cone-shaped working surface of the striker 2 or 3, and increases with an increase in the thickness t of the plate and the angle β.

It also can be seen in FIG. 5 that when the plate 1 leaves the deformation area, the component $+F_1$ decreases to 0.

If the strikers 2 and 3 are rotated in the direction opposite to the movement direction of the plate 1, then, correspondingly, the force component $-F_1$ appears, which is directed toward the strikers 2 and 3 and facilitates movement of metal in the upper layers of the plate 1 toward the strikers 2 and 3.

Hence, when deforming the plate 1 by ultrasonic forging at rotating the strikers 2 and 3 in the movement direction of the plate 3, the frictional forces create conditions, which retard the flow of metal layers adjacent to the forming cone-shaped surfaces of the strikers 2 and 3. It enables to raise wear resistance of the strikers 2 and 3 significantly, especially in their critical, most subject to wear area, namely, in the area of forming the edge of a wedge-shaped blade, as well as exclude a hidden defect in the form of a narrow slit-like microscopic void located in the plane of symmetry of the cutting edge due to slower flow of the outer layers of the plate 1. In such a case a plate with a rectangular end may be used.

And, when the strikers 2 and 3 are rotated in the direction opposite to the movement direction of the plate 1, transverse strains are created in the outer layers of the wedge-shaped cutting edge being formed, which facilitate metal flow, accelerate the ultrasonic forging process and result in producing the thinnest and sharpest cutting edge of a wedge-shaped blade. In this case it is advisable to use a blank—plate 1 with a rounded end.

It follows from the above examples that a compromise variant is also possible, when one of the strikers, e.g., the striker 2, is rotated in the movement direction of the plate 1, and the other striker, e.g., the striker 3 is rotated in the direction opposite to the movement direction of the plate 1. This variant is preferable for producing a cutting edge of minimum thickness due to the creation of frictional forces directed to the opposite sides.

A rather big number of experiments were carried out for producing razor blades blanks. For this the plate 1—a band with the thickness t=0.1 mm was used. Ultrasonic vibrations were applied at the frequency of 20 kHz. The following parameters were used: α=9.5°; β=14°, d'=15 mm; D=18 mm;

$V_n$=10 m/min≈17 mm/s; the speed of the strikers≈22 rpm. The frictional force component $+F_1$ ($-F_1$) was 24% of $+F^{fr}$ ($-F^{fr}$).

First, the strikers 2 and 3 were rotated in the movement direction of the plate 1 made with a rectangular end. It became possible to produce app. 19% of the blanks having practically no burrs, 58% of the blanks with a burr 0.01 to 0.03 mm, 23% of the blanks with a burr 0.03 to 0.05 mm.

Then the strikers were rotated in the direction opposite to the movement direction of the plate 1 made with a rounded end. It became possible to produce app. 28% of the blanks having practically no burrs, 61% of the blanks with a burr 0.01 to 0.03 mm, 11% of the blanks with a burr 0.03 to 0.05 mm.

After that the strikers 2 and 3 were rotated in the opposite directions. For the plate 1 made with a rounded end it became possible to obtain the cutting edge sharpness 1-1.5 microns. 32% of the blanks had practically no burrs, 64% of the blanks had burrs 0.01-0.03 mm, 4% of the blanks had burrs 0.03-0.05 mm.

For the plate 1 made with a rectangular end it became possible to obtain the cutting edge sharpness 1.3-1.6 microns. 32% of the blanks had practically no burrs, 62% of the blanks had burrs 0.01-0.03 mm, 8% of the blanks had burrs 0.03-0.05 mm.

In the claimed method the working cone-shaped surface of the strikers 2 and 3, which uniformly moves, due to rotation, along the deformed end of the plate 1, is subject to wear along the whole periphery, rather than on a local area; this leads to many-time increase of wear resistance of the strikers 2 and 3 and, correspondingly, to more infrequent stops of the process and re-adjustments of the equipment.

In order to speed up the process of ultrasonic forging, producing a wedge-shaped edge of higher quality from the plate 1, as well as decreasing wear of the working surfaces of the strikers 2 and 3, on each of the strikers 2 and 3 (see FIG. 6) a recess with a curvilinear generatrix is additionally made. This recess is made along the whole periphery of the striker working surface. Its making enables to decrease the deformation force, ensure a flow of lesser volumes of the metal outer layers toward the strikers 2 and 3, and, consequently, improve the quality of the wedge-shaped surface of the blade and its cutting edge. At that, the said curvilinear generatrix of the recess on the cone-shaped surface of the strikers may correspond to the form of a wedge-shaped edge surface thus produced for producing such edge for one pass of the plate 1.

In a case of a small burr (variant $I^a$ in FIG. 3) the plate 1 is thermally treated (hardened), and after that the wedge-shaped cutting edge is finished (treated with leather discs) to a depth of 0.01 to 0.05 mm. FIG. 9 shows a common variant of finishing the cutting edge with the use of leather discs 20. This variant is suitable when making, e.g., razor blades, various medical tools, scalpels, tools for microsurgery, etc. In the ideal case (variant $I^c$ in FIG. 3), or if rather flexible technical requirements to the quality of the cutting edge are set, e.g., when making knives, scissors, etc., a plate 1 is subject to thermal treatment only, and, if necessary, to subsequent usual grounding of the respective tool.

It should be also noted that ultrasonic forging enables to make a cutting edge before hardening a material, and after that treat it thermally and finish the cutting edge. Common grounding methods of making tools require a material, which is thermally hardened already. Therefore, those skilled in the art will understand that the making of tools by ultrasonic forging is much less labor-intensive, as compared to traditional methods of grounding.

Thus, the device for carrying out the claimed method of making cutting tool edges (FIG. 1) comprises the strikers 2 and 3 connected to sources of ultrasonic vibrations, i.e., the converters 13 and 14. The strikers 2 and 3 are arranged one opposite the other, and their working surfaces are made cone-shaped, rather than strictly conical, i.e., with reduction in the cross-section diameter in one direction, so as the cross-section diameter in the part of a striker, which forms the cutting edge, is less than the cross-section diameter in the part of that striker, which forms the periphery of the wedge-shaped edge. The device comprises a mechanism (not shown in FIG. 1) ensuring movement of a plate 1 between the working surfaces of the strikers 2 and 3 transversely relative to their longitudinal axes. The said mechanism is made on the base of the guide 10, which is spatially installed with the possibility of ensuring deformation of a side of the plate 1. A specific feature of the claimed device is the addition of a drive made with the possibility of rotating the strikers 2 and 3 around their longitudinal axes. The drive, e.g., may be comprise two electric motors 4 and 5, the shafts of which are connected via gear trains having sleeves 8 and 9. The sleeves 8 and 9 are attached to the waveguides 6 and 7.

The operation of the claimed device has been described in detail earlier, in the section on the claimed method.

Furthermore, a specific feature of the claimed device is that its strikers have a recess on the working surface. The generatrix of this recess may be made in correspondence with the surface form of a wedge-shaped edge.

When using traditional grounding methods, for several passes it is possible to make a finished product similar to a product that may be made with the use of the claimed striker for one pass, i.e., a striker, which working surface has a recess with a curvilinear generatrix. For example, the Moscow Plant "Mostochlegmash" produced razor blades, and a cross-section of such a wedge-shaped blade has the appearance shown in FIG. 7. Due to the use of the multi-pass grounding process the surface of a wedge-shaped blade consists of several planes, which, in their cross-section, form a broken line with angles gradually diminishing in the direction from the cutting edge of the blade. In the result, when using grounding products with rough surface are always obtained.

Such a product, however, may be made with a smooth surface, if ultrasonic forging is used.

A broken line may be mathematically expressed, in particular, by a quadratic polynomial.

After establishing typical points of breakage of a broken line in the cross-section shown in FIG. 7 and substituting their coordinate values to a quadratic polynomial of the kind $Y=\pm AX^2\pm BX\pm C$, where Y is the direction along the transverse axis of the striker 2 or 3, and X is the direction along the longitudinal axis of the striker 2 or 3, the broken line is approximated to a curve (see FIG. 6). Thus, a recess with a curvilinear generatrix is determined by the said quadratic polynomial. Thus, for a particular wedge-shaped edge produced by grounding (see FIG. 7) the curvilinear generatrix of the recess is described by the quadratic polynomial $Y=-0.135X^2-0.0646X+0.05$ (see FIG. 8). On the working surfaces of the strikers 2 and 3 a recess is duly made with the curvilinear generatrix described by this equation. In the result, a similar product is made by ultrasonic forging, but it has a smooth surface and improved strength characteristics. Moreover, as it has been already said, making a recess with a curvilinear generatrix on the working surface of the striker improves the conditions for flow of metal layers at the time of ultrasonic forging.

The claimed method of making a cutting tool edge, the device for carrying out the claimed method, and a striker included in the said device may be most successfully industrially applied for making various tools having improved performance, high wear resistance parameters and cutting edges of small thicknesses.

The invention claimed is:

1. A method of making a cutting edge of a cutting device, said cutting device comprising a plate with a plate region adjacent to an edge, wherein at least a portion of the plate region and the edge are positioned between two strikers of an ultrasonic forging device, wherein the cutting edge is formed from the plate region and the edge by simultaneously moving the plate in a direction parallel to the edge and essentially orthogonal to the longitudinal axes (L1, L2) of the strikers during operation of the strikers, and wherein the strikers are rotated around their longitudinal axes (L1, L2) during operation, and wherein when deforming the edge by ultrasonic forging the edge is deepened toward the working surfaces to a distance l, which is selected in the interval $1.1t/(4tg\,\alpha)>l\geq t/(4tg\,a)$, where t is the plate thickness, and $\alpha$ is the angle between the generatrix of the cone-shaped working surface and the center plane (Z) of the plate.

2. The method according to claim 1, wherein both strikers are rotating such that the tangential velocity movement direction ($V_0$) of such parts of working surfaces of both strikers, which come in contact with the edge, are essentially parallel with the direction ($V_n$) of the plate movement, or wherein the tangential velocity movement directions ($V_0$) are essentially antiparallel with the direction ($V_n$) of the plate movement, or wherein the tangential velocity movement direction ($V_0$) of one striker is parallel and of the other is antiparallel with the direction ($V_n$) of the plate movement.

3. The method according to claim 1, wherein the strikers are rotating with a tangential velocity ($|V_n|$), measured at the radius (R) of the working surfaces which first comes into contact with the edge, being selected from an interval $|V_{rot}|=\pm\chi|V_n|$, wherein $|V_n|$ is the velocity of the plate movement, and $\chi$ is a value in the range from 0.1 to 1.5.

4. The method according to any of the claims 1 to 3, wherein the working surface of at least one striker is cone-shaped with a curvilinear generatrix.

5. The method according to claim 4, wherein the curvilinear generatrix of the cone-shaped working surface is described by the quadratic polynomial $Y=\pm AX^2\pm BX\pm C$, where Y is the direction along the transverse axis of the striker, and X is the direction along the longitudinal axis of the striker.

6. The method according to claim 5, wherein the curvilinear generatrix of the cone-shaped working surface is described by the quadratic polynomial $Y=-0.135X^2-0.0646X+0.05$, wherein the parameters A, B, and C may optionally be varied by less than ±5%, preferably less than ±2%.

7. The method according to any of the claims 1 to 3, wherein the at least the cutting edge, preferably the plate, is made of a metallic material.

8. The method according to any of the claims 1 to 3, wherein the plate is thermally treated after ultrasonic forging, and after said thermal treatment the cutting edge of the cutting device is finished to a depth of 0.01-0.05 mm.

9. The method according to any of the claims 1 to 3, wherein the cutting device is a razor blade band, a medical tool, a scalpel, or a tool for microsurgery.

10. A device for making a cutting edge of a cutting device from a plate, comprising:

a) two strikers connected to sources of ultrasonic vibrations, the strikers arranged one opposite the other and having cone-shaped working surfaces, b) means to move the plate in directions parallel to the edge of the plate and transversely to the longitudinal axes (L1, L2) of the strikers, and c) means to rotate the strikers around their longitudinal axes (L1, L2) simultaneously with movement of the plate during operation of the strikers, wherein when deforming a plate side by ultrasonic forging the plate end is deepened toward the working surfaces to a distance l, which is selected in the interval $1.1t/(4tg\,\alpha)>l\geq t/(4tg\,\alpha)$, where t is the plate thickness, and $\alpha$ is the angle between the generatrix of the striker cone-shaped surface and the transverse axis of the plate.

11. The device according to claim 10, wherein both strikers are rotatable such that the tangential velocity movement direction ($V_0$) of such parts of working surfaces of both strikers, which come in contact with the edge, are essentially parallel with the direction ($V_n$) of the plate movement, or wherein the tangential velocity movement directions ($V_0$) are essentially antiparallel with the direction ($V_n$) of the plate movement, or wherein the tangential velocity movement direction ($V_0$) of one striker is parallel and of the other is antiparallel with the direction ($V_n$) of the plate movement.

12. The device according to claim 10, wherein the working surfaces of the cone-shaped strikers have a curvilinear generatrix.

13. The device according to any of the claims 10 to 12, wherein the curvilinear generatrix of the cone shaped working surface is described by the quadratic polynomial $Y=\pm AX^2\pm BX\pm C$, where Y is the direction along the transverse axis of the striker, and X is the direction along the longitudinal axis of the striker.

14. The device according to claim 13, wherein the curvilinear generatrix of the cone shaped working surface is described by the quadratic polynomial $Y=-0.135X^2-0.0646X+0.05$, wherein the parameters A, B, and C may optionally be varied by less than ±5%, preferably less than ±2%.

15. A method of making a cutting tool edge, comprising deforming a plate end, as located between the conical surfaces of strikers, by ultrasonic forging, with simultaneously moving the plate relative to the longitudinal axes (L1, L2) of the strikers in the transverse direction for the purpose of forming a wedge-shaped edge on the plate, characterized in that when deforming a side of the plate by ultrasonic forging the strikers are rotated around their longitudinal axes (L1, L2), wherein when deforming a plate side by ultrasonic forging the plate end is deepened toward the striker working surfaces a distance l, which is selected in the interval $1.1t/(4tg\,\alpha)>l\geq t/(4tg\,\alpha)$, where t is the plate thickness, and $\alpha$ is the angle between the generatrix of the striker cone-shaped surface and the transverse axis of the plate.

16. The method according to claim 15, characterized in that the strikers are rotated in the movement direction ($V_n$) of the plate.

17. The method according to claim 15, characterized in that the strikers are rotated in the direction opposite to the movement direction ($V_n$) of the plate.

18. The method according to claim 15, characterized in that one striker is rotated in the movement direction ($V_n$) of the plate and the other striker is rotated in the direction opposite to the movement direction ($V_n$) of the plate (1).

19. The method according to claim 15, characterized in that the circumferential rotational velocity of the strikers is selected in the interval $V_{rot}=\pm\chi V_n$ where $V_n$ is the speed of the plate movement, and $\chi$ is a value in the range from 0.1 to 1.5.

20. The method according to claim 15, characterized in that on each striker a recess with a curvilinear generatrix on its cone-shaped surface is made, the said curvilinear generatrix corresponding to the form of a wedge-shaped blade surface produced.

21. The method according to claim 15, characterized in that after deformation the plate is thermally treated, and afterwards the edge of the wedge-shaped blade is finished to a depth of 0.01-0.05 mm.

22. A device for making cutting tool edges, comprising strikers connected to sources of ultrasonic vibrations, arranged one opposite the other, and having working surfaces made cone-shaped, and a mechanism made so as to ensure the plate movement between the striker working surfaces transversely, relative to their longitudinal axes (L1,L2) and installed with the possibility of deforming a plate side characterized in that a drive is provided, the drive configured to rotate the strikers around their longitudinal axes (L1,L2), wherein a distance l, to which the plate end is deepened toward the striker surfaces, is selected in the interval $1.1t/(4tg\ \alpha)>l\geq t/(4tg\ \alpha)$, where t is the plate thickness, and $\alpha$ is the angle between the generatrix of the striker cone-shaped surface and the transverse axis of the plate.

23. The device according to claim 22, characterized in that the drive is configured to rotate the strikers in the movement direction of the plate.

24. The device according to claim 22, characterized in that the drive is configured to rotate the strikers in the direction opposite to the movement direction of the plate.

25. The device according to claim 22, characterized in that the drive is configured to rotate one striker in the movement direction of the plate and rotating the other striker in the direction opposite to the movement direction of the plate.

26. The device according to claim 22, characterized in that on the cone-shaped surface of the striker a recess with a curvilinear generatrix is made.

27. The device according to claim 22, characterized in that a curvilinear generatrix of the recess is described by the quadratic polynomial $Y=\pm AX^2\pm BX\pm C$, where Y is the direction along the transverse axis of the striker, and X is the direction along the longitudinal axis (L1,L2) of the striker.

28. The device according to claim 22, characterized in that a curvilinear generatrix is described by the quadratic polynomial $Y=-0.135X^2-0.0646X+0.05$.

29. A striker for ultrasonic making of a cutting tool edge, which has the working surface made cone-shaped and intended for deforming a plate side by ultrasonic forging for the purpose of producing a wedge-shaped blade, characterized in that on the cone-shaped working surface a recess is made, the generatrix of which is made corresponding to the surface form of a wedge-shaped edge, wherein the recess is made with a curvilinear generatrix described by the quadratic polynomial $Y=\pm AX^2\pm BX\pm C$, where Y is the direction along the transverse axis of the striker, and X is the direction along the longitudinal axis (L1,L2) of the striker, wherein when deforming a plate side by ultrasonic forging the plate end is deepened toward the striker working surfaces a distance l, which is selected in the interval $1.1t/(4tg\ \alpha)>l\geq t/(4tg\ \alpha)$, where t is the plate thickness, and $\alpha$ is the angle between the generatrix of the striker cone-shaped surface and the transverse axis of the plate.

30. The striker according to claim 29, characterized in that the curvilinear generatrix is described by the quadratic polynomial $Y=-0.135X^2-0.0646X+0.05$.

* * * * *